United States Patent [19]

Nishigaki

[11] Patent Number: 4,592,984

[45] Date of Patent: Jun. 3, 1986

[54] MULTILAYER ELECTROPHOTOGRAPHIC PHOTOSENSITIVE MEMBER

[75] Inventor: Yuji Nishigaki, Tokyo, Japan

[73] Assignee: Canon Kabushiki Kaisha, Tokyo, Japan

[21] Appl. No.: 628,125

[22] Filed: Jul. 9, 1984

Related U.S. Application Data

[63] Continuation of Ser. No. 445,071, Dec. 9, 1981, abandoned.

[30] Foreign Application Priority Data

Dec. 9, 1981 [JP] Japan ..... 56-199128

[51] Int. Cl.[4] ..... G03G 5/14

[52] U.S. Cl. ..... 430/59; 430/63; 430/31; 430/945

[58] Field of Search ..... 430/58, 59, 76, 78, 430/62, 63

[56] References Cited

U.S. PATENT DOCUMENTS

| | | | |
|---|---|---|---|
| 3,816,118 | 6/1974 | Byrne . | |
| 3,895,944 | 7/1975 | Wiedemann et al. | 430/59 |
| 4,150,987 | 4/1979 | Anderson . | |
| 4,218,528 | 8/1980 | Shimada et al. | 430/76 |
| 4,278,747 | 7/1981 | Murayama et al. | 430/59 X |
| 4,377,629 | 3/1983 | Takumi et al. | 430/62 |

FOREIGN PATENT DOCUMENTS

| | | | |
|---|---|---|---|
| 51-109841 | 9/1976 | Japan | 430/76 |
| 57-20741 | 2/1982 | Japan | 430/58 |
| 57-56942 | 4/1982 | Japan | 430/59 |
| 57-54942 | 4/1982 | Japan | 430/78 |
| 57-54943 | 4/1982 | Japan | 430/78 |

*Primary Examiner*—Roland E. Martin

*Attorney, Agent, or Firm*—Fitzpatrick, Cella, Harper & Scinto

[57] ABSTRACT

An electrophotographic photosensitive member comprising a photosensitive layer having a laminated structure of charge generation and charge transport layers on a conductive substrate is characterized in that the charge generation layer contains a copper phthalocyanine pigment and the charge transport layer contains a hydrazone compound and a binder.

A process for forming electrostatic latent images comprises the steps of (1) giving electric charge to the face of an electrophotographic photosensitive member comprising a photosensitive layer having a laminated structure on a conductive substrate, said laminated structure consisting of a charge generation layer containing copper phthalocyanine and a charge transport layer containing a hydrazone compound and a binder and (2) scanning the charged face with a laser beam.

An image-forming process comprises the steps of (1) giving electric charge to the face of an electrophotographic photosensitive member having a photosensitive layer of a laminated structure on a conductive substrate, said laminated structure consisting of a charge generation layer containing copper phthalocyanine and a charge transport layer containing a hydrazone compound and a binder, (2) scanning the charged face with a laser beam, and (3) developing the resulting electrostatic latent image with a developer.

A process for preparing an electrophotographic photosensitive member, comprises the steps of (1) applying a dispersion of copper phthalocyanine in a resin solution onto an aluminum cylinder by dip coating to form a charge generation layer and (2) applying a hydrazone compound dissolved in a resin solution onto the previously formed charge generation layer by dip coating to form a charge transport layer thereupon.

25 Claims, 2 Drawing Figures

FIGURE I. X-RAY DIFFRACTION SPECTRA OF CuPc POLYMORPHS.

MULTILAYER ELECTROPHOTOGRAPHIC PHOTOSENSITIVE MEMBER

This application is a continuation of application Ser. No. 445,071 filed Dec. 9, 1981, now abandoned.

BACKGROUND OF THE INVENTION

1. Field of the Invention

This invention relates to electrophotographic photosensitive members and more particularly to those suited for electrophotographic printers employing a semiconductor laser as light source.

2. Description of the Prior Art

It suffices for a photosensitive member to be spectrally sensitized to light wavelength of about 650 nm or shorter when the light source used for operating is a gas laser such as a helium-cadmium laser (emission wavelength 441.6 nm) or a helium-neon laser (emission wavelength 632.8 nm). As examples of such a photosensitive member, there are known (1) those using a charge transfer complex of polyvinylcarbazole with trinitrofluorenone for a photosensitive layer, (2) those employing a selenium-sensitized tellurium vacuum deposition layer as a photosensitive member, (3) those comprising a conductive layer, a charge transport layer of selenium vacuum-deposited on the conductive layer, and a selenium-tellurium layer vacuum-deposited on the charge transport layer, (4) those using cadmium sulfide spectrally sensitized with a pigment sensitizer, for a photosensitive layer, and (5) those comprising two separately functioning photosensitive layers: a charge generation layer, which contains an organic pigment to extend the sensible wavelength range to the longer side, and a charge transport layer.

Meanwhile, semiconductor laser transmitters of small size and of low cost have been developed in recent years which additionally can be directly modulated. However, these semiconductor lasers in many cases have emission wavelengths of 750 nm or longer and the above-mentioned photosensitive members are insensitive at all or almost completely to the light of 750 nm or longer in wavelength, so that it is difficult to use semiconductor lasers for electrophotographic printers.

Although attempts have been made to extend the maximum sensible wavelength of photosensitive members to 750 nm or longer by sensitization, these have the following disadvantages: The layer structure of photosensitive layer becomes complicated and setting of operational conditions in the production of photosensitive members becomes more difficult; sensitizing pigments or dyes used fade out during repetitions of light exposure and electric charging, and eventually image recording with semiconductor lasers becomes infeasible; and said photosensitive members comprising separately functioning charge generation and charge transport layers, although sensitized to extend their sensible wavelength range to the longer side, cannot obtain adequate sensitivity and exhibit undesirable photomemory, thereby causing various troubles.

SUMMARY OF THE INVENTION

The present invention has been achieved to solve the above mentioned problems.

The primary object of this invention is to provide electrophotographic photosensitive members suitable for electrophotographic printers employing a laser as light source which are free from the foregoing disadvantages.

An object of this invention is to provide electrophotographic photosensitive members suitable for electrophotographic printers employing a laser light source emitting a beam of wavelength 650 nm or longer.

Another object of this invention is to provide electrophotographic photosensitive members suitable for electrophotographic printers employing a laser light source emitting a beam of wavelength 750 nm or longer.

A further object of this invention is to provide electrophotographic photosensitive members highly sensitive to light beams of 750 nm and longer in wavelength.

An even further object of this invention is to provide electrophotographic photosensitive members improved in respect to photomemory.

According to one aspect of the present invention, there is provided an electrophotographic photosensitive member comprising a photosensitive layer having a laminated structure of charge generation and charge transport layers on a conductive substrate, which is characterized in that the charge generation layer contains a copper phthalocyanine pigment and the charge transport layer contains a hydrazone compound and a binder.

According to another aspect of the present invention, there is provided a process for forming electrostatic latent images which comprises the steps of (1) giving electric charge to the face of an electrophotographic photosensitive member comprising a photosensitive layer having a laminated structure on a conductive substrate, said laminated structure consisting of a charge generation layer containing copper phthalocyanine and a charge transport layer containing a hydrazone compound and a binder and (2) scanning the charged face with a laser beam.

According to a further aspect of the present invention, there is provided an image-forming process comprising the steps of (1) giving electric charge to the face of an electrophotographic photosensitive member having a photosensitive layer of a laminated structure on a conductive substrate, said laminated structure consisting of a charge generation layer containing copper phthalocyanine and a charge transport layer containing a hydrazone compound and a binder, (2) scanning the charged face with a laser beam, and (3) developing the resulting electrostatic latent image with a developer.

According to still another aspect of the present invention, there is provided a process for preparing an electrophotographic photosensitive member, which comprises the steps of (1) applying a dispersion of copper phthalocyanine in a resin solution onto an aluminum cylinder by dip coating to form a charge generation layer and (2) applying a hydrazone compound dissolved in a resin solution onto the previously formed charge generation layer by dip coating to form a charge transport layer thereupon.

DETAILED DESCRIPTION OF THE PREFERRED EMBODIMENTS

Electrophotographic printers utilizing a laser as light source can reproduce a desired image as follows: Original image information is converted into digital signals, a laser beam is modulated with electric signals varying in response to the digital signals, and a photosensitive member surface is scanned with this modulated laser beam by means of a galvanomirror or the like to form an electrostatic latent image, which is developed with a toner and than transferred to recording paper or the like. The lasers commonly used are gas lasers such as helium-cadmium laser (emission wavelength 441.6 nm) and helium-neon laser (emission wavelength 632.8 nm) and a gallium-aluminum-arsenic semiconductor laser (emission wavelength 780 nm).

This invention is characterized in that first place by incorporation of a copper phthalocyanine pigment into the charge generation layer.

Of the various types of copper phthalocyanine used in this invention, the type $\epsilon$ is particularly preferred. The copper phthalocyanine of $\epsilon$ type can be prepared by the process described in Japanese Patent Publication No. 2780/1965, that is, by condensation of phthalic anhydride, copper or a copper salt, and urea or by condensation of phthalodinitrile, copper or a copper salt, and urea, in the presence or absence of a catalyst, wherein the condensation is carried out by adding phthalic anhydride or phthalodinitrile in limited amounts to a melt containing a large excess of urea (3–15 times the weight of phthalic anhydride or phthalodinitrile) and the product is subjected to the salt milling process.

Figure 1:
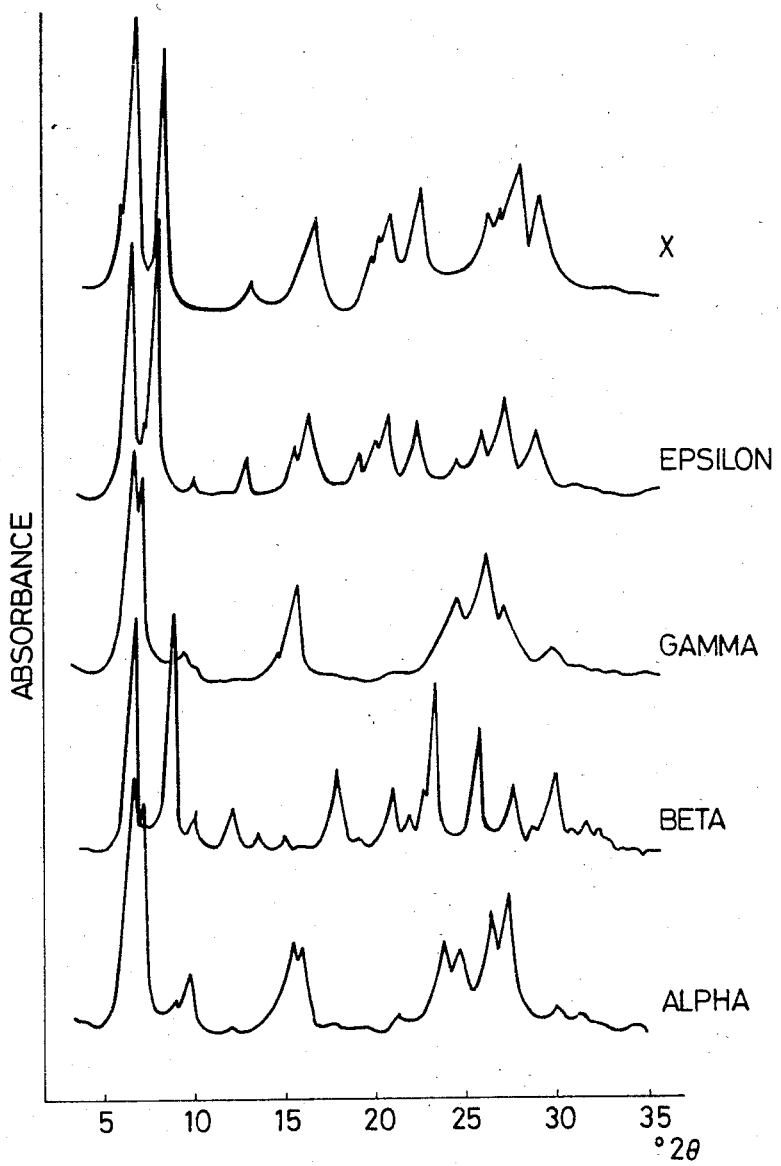
FIG. 1 shows X-ray diffraction spectra ($2\theta$) of copper phthalocyanines of types X, $\epsilon$, $\gamma$, $\beta$, and $\alpha$.

As shown in FIG. 1, such copper phthalocyanine of type $\epsilon$ exhibits X-ray diffraction angles ($2\theta$), as measured with CuK$\alpha$/Ni by use of a Geiger counter-equipped X-ray diffraction apparatus (power method), which correspond to interplanar spacings of 11.63, 9.72, 6.24, 5.10, 4.35, 4.19, 3.87, 3.36, 3.28, 3.19, and 3.03 Å. This X-ray diffraction spectrum is different from those of copper phthalocyanines of types $\alpha$, $\beta$, and $\gamma$, and also of type X disclosed in U.S. Pat. No. 3,816,118; these spectra ($2\theta$) are also shown in FIG. 1.

The charge generation layer in this invention can be formed by means of various film-forming methods by coating of a dispersion of said pigment in a binder solution, preferably by coating, either directly on the conductive substrate or on an intermediary layer (undercoat) laid thereupon. It is also possible to form the charge generation layer on a charge transport layer, which will be described later in detail. In this case, the charge generation layer may be coated with a protective layer comprising a high polymer, for example, polyethylene, poly(vinyl chloride), poly(vinyl acetate), polycarbonates, polyesters, or poly(vinyl butyral).

When the charge generation layer is formed by coating a dispersion of copper phthalocyanine, this dispersion is free from or contains a binder, for example, poly(vinyl butyral), poly(vinyl acetal), polyesters, polycarbonates, polyamides, polyurethanes, or phenolic resins. It is desirable that the binder resin content in the charge generation layer be restricted relatively low. In general, the weight ratio of the binder to copper phthalocyanine, in the charge generation layer, is 1:1–1:3 , preferably 1:1.5–1:25. In particular, the weight ratio of 1:ca. 2 gives best results.

For dispering copper phthalocyanine, known means such as ball mills and attritors are available, whereby particle sizes of the pigment is made desirably 5$\mu$ or less, preferably 0.5$\mu$ or less. The dispersion of the pigment thus prepared is coated by any of coating methods of blade coating, Meyer-bar coating, spray coating, dip coating, curtain coating, bead coating, etc. Suitable thickness of the charge generation layer is up to 5$\mu$, preferably 0.01–1$\mu$.

The coating liquid for forming the charge generation layer also contains an organic solvent, which can be selected from a number of organic solvents. Typical examples of the solvents are aromatic hydrocarbons such as benzene, naphthalene, toluene, xylene, mesitylene, chlorobenzene, and the like; ketones such as acetone, 2-butanone, and the like; halogenated aliphatic hydrocarbons such as methylene chloride, chloroform, ethylene chloride, and the like; cyclic or linear ethers such as tetrahydrofuran, ethyl ether, and the like; and mixtures of these solvents.

While types $\alpha$, $\beta$, $\gamma$, and X are known, besides type $\epsilon$, as crystal forms of phthalocyanine pigment, charge generation layers formed from copper phthalocyanine pigments of the types other than type $\epsilon$ have proved to generate less charge carriers as compared with a charge generation layer formed from the pigment of type $\epsilon$, when they are exposed to a laser beam of 750 nm or longer in wavelength. On the contrary, an electrophotographic photosensitive member having a charge generation layer containing copper phthalocyane of type $\epsilon$ is capable of injecting effectively electric charges into its charge transport layer, which are generated on exposure to a laser beam of 750 nm or in wavelength, and therefore can exhibit a high sensitivity. For choosing a charge transporting material used in this case, a great number of experiments are repeated in practice though an approach has been proposed which utilizes the ionization potential of a material to be used for charge transport as a measure. In particular, electrophotographic characteristics of photosensitive members, for example, the photomemory property, other than the sensitivity are nonpredictable at all.

Thus, this invention is characterized in the second place by using a hydrazone compound-containing specific charge transport layer which faces the copper phthalocyanine-containing charge generation layer. This photosensitive layer of laminated structure exhibits an extremely high sensitivity to rays of 650 nm and longer, particularly 750 nm and longer, in wavelength and at the same time has an improved antiphotomemory property as compared with conventional photosensitive members, so far known, for use in laser printers.

The charge transport layer in this invention is preferably formed by coating a solution of a hydrazone compound together with a binder in a suitable solvent and drying it. Binders used for this purpose include polysulfone, acrylic resins, methacrylic resins, vinyl chloride resin, vinyl acetate resin, phenolic resins, epoxy resins, polyester resins, alkyd resins, polycarbonates, polyurethanes, and copolymers comprising two or more kinds of repeating units of these resins, of which polyester resins and polycarbonates are preferred. A photoconductive polymer having in itself a charge-transporting ability such as poly(N-vinylcarbazole) can also be used as the binder. Blending ratios of the binder to the charge-transporting compound are preferably in the range 100:10–100:500 by weight. Thickness of the charge transport layer is in the range 2–100$\mu$, preferably 5–30μ. Coating methods applicable to the formation of the charge transport layer may be usual ones including blade coating, Meyer-bar coating, spray coating, dip coating, bead coating, air-knife coating, curtain coating, etc.

Solvents used in the formation of the charge transport layer of this invention include a number of organic solvents. Typical examples thereof are aromatic hydrocarbons such as benzene, naphthalene, toluene, xylene, mesitylene, chlorobenzene, and the like; ketones such as acetone, 2-butanone, and the like; halogenated aliphatic hydrocarbons such as methylene chloride, chloroform, ethylene chloride, and the like; cyclic or linear ethers such as tetrahydrofuran, ethyl ether, and the like; and mixtures of these solvents.

Various additives can be incorporated into the charge transport layer of this invention. Such additives include diphenyl, chlorinated diphenyls, o-terphenyl, p-terphenyl, dibutyl phthalate, dimethyl glycol phthalate, dioctyl phthalate, triphenyl phosphate, methylnaphthalene, benzophenone, chlorinated paraffin, dilauryl thiodipropionate, 3,5-dinitrosalicyclic acid, various kinds of fluorocarbons, silicone oils, silicone rubbers, and phenolic compounds such as dibutyl hydroxytoluene, 2,2'-methylene-bis(6-t-butyl-4-methylphenol), α-tocopherol, 2-t-octyl-5-chlorohydroquinone, 2,5-di-t-octylhydroquinone, and the like.

Hydrazone compounds particularly preferred in this invention are those represented by the formula

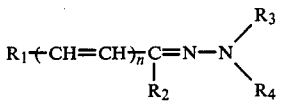

(1)

wherein $R_1$, $R_2$, $R_3$, $R_4$, and n are as follows: $R_1$ represents aryl such as phenyl or heterocyclic residue such as carbazolyl, furyl, pyridyl, benzimidazolyl, benzoxazolyl, benzothiazolyl, and the like.

This aryl or heterocyclic residue is allowed to be substituted by alkyl such as methyl, ethyl, propyl, butyl, amyl and the like; alkoxy such as methoxy, ethoxy, propoxy, butoxy, and the like; di-substituted amino such as dimethylamino, diethylamino, dipropylamino, dibutylamino, dibenzylamino, diphenylamino, ditolylamino, dixylylamino, and the like; halogen such as chlorine, bromine, and the like; hydroxyl; or carboxyl. $R_1$ especially suitable is the phenyl having a dialkylamino substituent at the 4-position.

$R_2$ represents hydrogen, aryl (e.g. phenyl, naphthyl, and the like), or substituted aryl (e.g. 4-dimethylaminophenyl, 4-diethylaminophenyl, 4-dipropylaminophenyl, 4-methoxyphenyl, 4-ethoxyphenyl, 2-methylphenyl, 2,4-dimethoxyphenyl, and the like).

$R_3$ and $R_4$ represent alkyl such as methyl, ethyl, propyl, butyl, amyl, and the like; aryl such as phenyl, naphthyl, and the like; or aralkyl such as benzyl, phenethyl, and the like. And n is 0 or 1.

Typical examples of the hydrazone compound used in this invention are numerated below. The following compounds also include the compounds other than ones represented by the aforesaid formula (1).

Hydrazone compound:

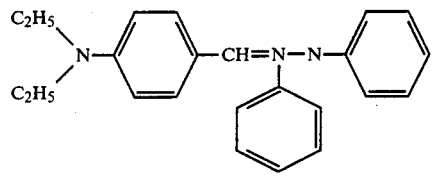

(1)

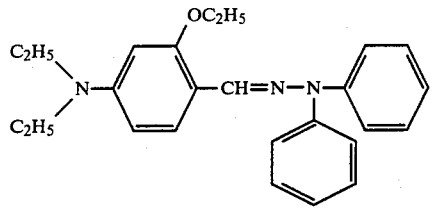

(2)

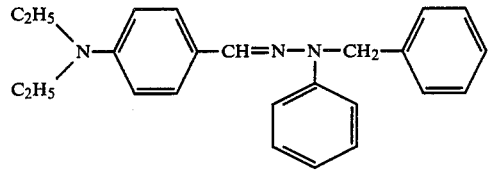

(3)

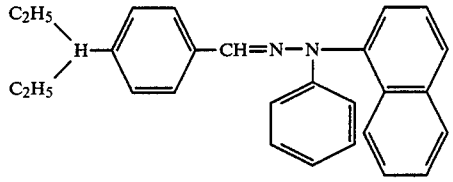

(4)

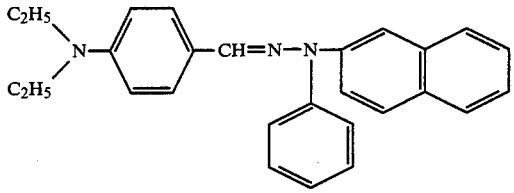

(5)

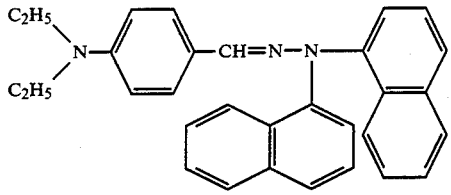

(6)

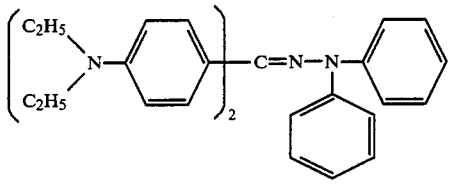

(7)

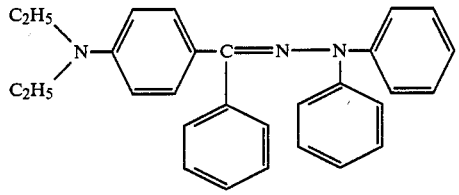

(8)

-continued (9)

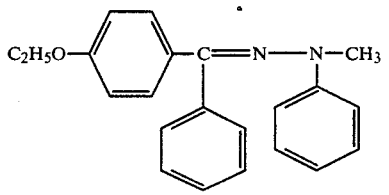

(10)

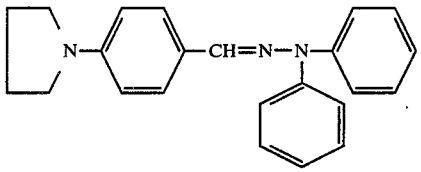

(11)

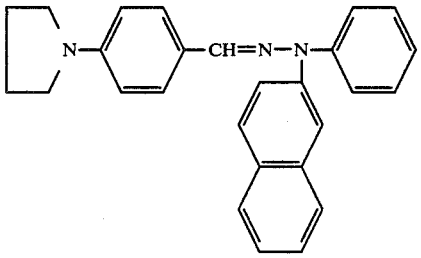

(12)

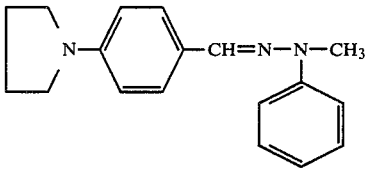

(13)

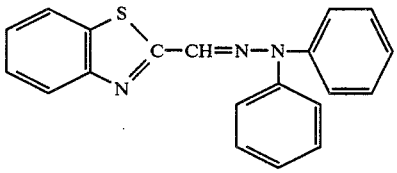

(14)

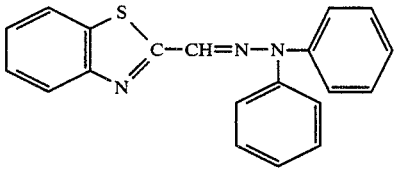

(15)

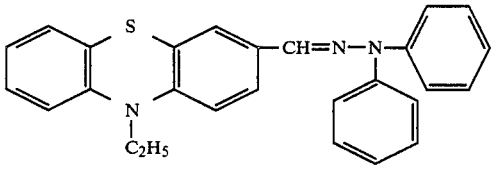

(16)

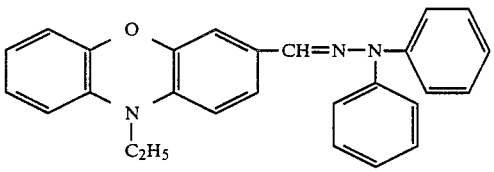

-continued (17)

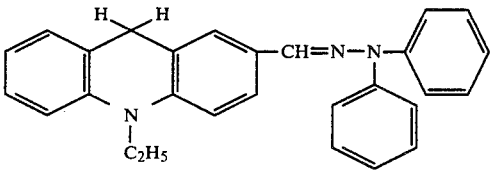

(18)

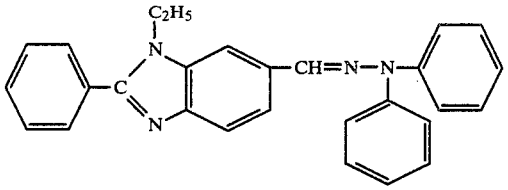

(19)

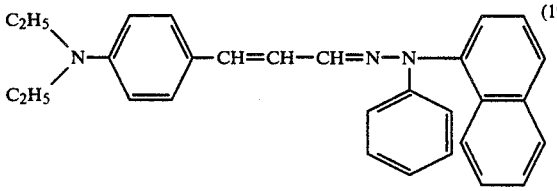

(20)

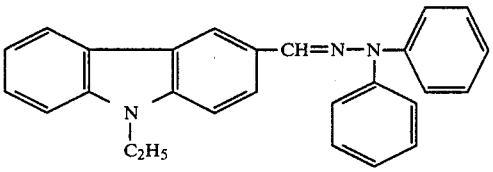

(21)

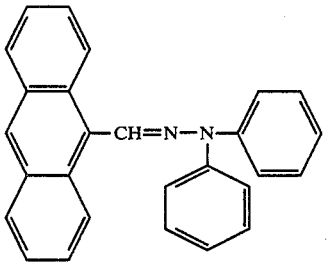

(22)

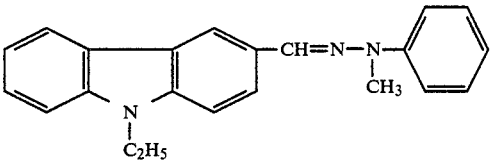

These compounds can be used singly or in combination two or more.

The electrophotographic photosensitive member of this invention can be prepared by forming the charge generation layer containing the foregoing dispersed phthalocyanine pigment in dispersion on a suitable substrate and laminating the charge transport layer containing the foregoing hydrazone compound, on the charge generation layer. As already stated, an intermediary layer can be formed between the charge generation and the conductive substrate. This intermediary layer inhibits the injection of free charges from the conductive substrate into the photosensitve layer, when the photosensitive layer of laminated structure is charged, and acts as an adhesive to fasten the photosensitive layer to the conductive substrate. The intermediary layer can be formed from aluminum oxide, indium oxide, tin oxide, an indium oxide-tin oxide mixture, polyethylene, polypropylene, acrylic resins, methacrylic resins, polyamide resins, vinyl chloride resin, vinyl acetate resin, phenolic resins, epoxy resins, polyester resins, alkyd resins, polycarbonates, polyurethanes, polyimide resins, vinylidene chloride resin, vinyl chloride-vinyl acetate copolymer, poly(vinyl alcohol), water-soluble copolymer of ethylene and acrylic acid, nitrocellulose, casein, gelatin, and the like. This layer can also be formed from a dispersion of conductive particles, for example, carbon black, silver particles, or aluminum particles, in a resin. With carbon black, in particular, it becomes possible to prevent the generation of an interference fringe upon forming the image. This interference fringe seems to be formed conceivably by the following mechanism: Since the thickness of the charge generation layer is as small as 0.01–1$\mu$, the quantity of laser beam absorbed in this layer is limited and the laser beam transmitted by this layer is reflected from the interface between this layer and the substrate; thus interference is caused between this reflected beam and the beam reflected from the surface of the photoconductive layer. When nd=integer x $\lambda/2$, wherein n is the refractive index of the photoconductive layer comprising the charge generation layer, d the thickness of the photoconductive layer, and $\lambda$ the wavelength of the layer beam, the intensity of reflected beam is maximum, that is, the intensity of beam entered the photoconductive layer is minimum. When n$\alpha$=odd number x $\lambda/4$, the intensity of said reflected beam is minimum, that is, the intensity of said beam entered the photoconductive layer is maximum. On the other hand, while it is difficult that a variation in the thickness d of the photoconductive layer is suppressed to 0.2$\mu$ or less in the preparation of the photoconductive layer, laser beams are coherent and highly monochromatic. Accordingly, the conditions of said interference varies with the variation in d, and the intensity of the beam absorbed in the photoconductive layer is locally nonuniform, thus an interference fringe-like nonuniformity in image density appearing throughout the recording surface.

Thickness of the intermediary or bond layer is in the range 0.1–5$\mu$, preferably 0.5–3$\mu$.

In the preparation of the electrophotographic photosensitive member of this invention, the surface of the charge generation layer may be subjected to mirror finishing as required for uniforming the injection of carriers from the charge generation layer into the upper charge transport layer. For example, the method disclosed in Japanese Patent Laid-Open No. 155356/1980 can be applied to the mirror finishing.

For the substrate in the electrophotographic photosensitive member of this invention, any kind of material that is provided with conductivity may be used; any type of conventional conductive substrate can be used. As example of the substrate may be cited metals such as aluminum, copper, stainless steel, bras, and the like; plastics on which aluminum, indium oxide, tin oxide, and the like is vacuum-deposited or laminated; and of resins in which conductive particles such as carbon black, silver particles, aluminum particles, and the like are dispersed. The shape of the substrate may be sheet-like, cylindrical, or of other form.

Figure 2:
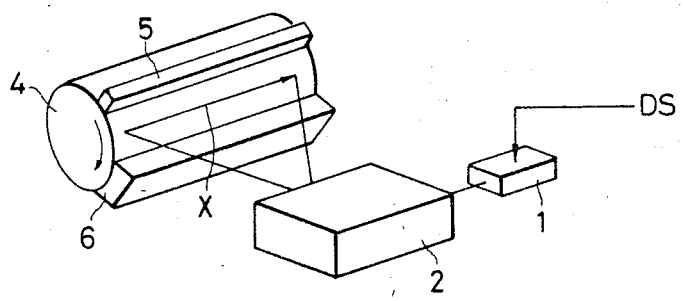
FIG. 2 is a perspective view showing the charging, irradiating, and developing units of an image-forming device which operates according to the laser beam scanning method.

When the electrophotographic photosensitive member of this invention is used, negative charges are given to the surface of the member, which is then scanned with an imaging laser beam, thereby an electrostatic latent image being formed on the surface. As stated before, laser beams available in this invention are those of helium-neon, helium-cadmium, semiconductors, etc. including those of long wavelengths, as 650 nm or longer, especially 750 nm or longer. The latent image-forming process is operated, for example, in the following way: As shown in FIG. 2, a semiconductor laser 1 is modulated with driving signals DS varying in response to the externally supplied image formation in the form of digital signals; the charged surface of photosensitive member 4 is scanned in the direction X with the modulated laser beam through an optical system 2 comprising light deflectors such as an imaging lens, a galvanomirror, and the like, to form an electrostatic latent image. In FIG. 2, reference numeral 5 represents a charging unit and reference numeral 6 a developing unit. The electrostatic latent image thus formed is developed by a developer with a positive toner to form a visible image.

The electrophotographic photosensitive member of this invention can be applied to processed using a laser as light source, for instance, to electrophotographic printing and electrophotographic printing-plate making systems.

According to this invention, there are provided electrophotographic photosensitive members having markedly higher sensitivity to the light of 750 nm or longer in wavelength as compared with the prior art electrophotographic photosensitive members for laser beams, and additionally being improved in anti-photomemory property.

This invention will be illustrated in more detail with reference to the following Examples:

EXAMPLE 1

A solution of casein in aqueous ammonia (casein 11.2 g, 28% aqueous ammonia 1 g, water 222 ml) was applied onto an aluminum cylinder by dip coating and dried to form an intermediate layer of 1.0 g/m$^2$ in coating weight.

Copper phthalocyanine of type $\epsilon$ (one part by weight, Lionol Blue ES, mfd. by Toyo Ink Manufacturing Co., Ltd.), a vinyl butyral resin (one part by weight, E slec BM-2, mfd. by Sekisui Chemical Co., Ltd.) and isopropanol (30 parts by weight) were dispersed in a ball mill for 4 hours. The resulting dispersion was applied onto the previously formed intermediary layer by dip coating and dried to form a charge generation layer 0.3$\mu$ thick.

Hydrazone compound No. 5 cited above (one part by weight) and a polysulfone resin (one part by weight, P 1700, mfd. by Union Carbide Corporation) were dissolved in monochlorobenzene (6 parts by weight) with stirring. This solution was applied onto the charge generation layer by dip coating and dried to form a charge transport layer 12$\mu$ thick.

The photosensitive member thus prepared was corona-charged at a voltage of −5 KV to measure the initial surface potential $V_o$ and the dark decay potential $V_5$ (the surface potential after 5-second standing in the dark). The sensitivity was evaluated with the exposure quantity for halving $V_5$ (E $\frac{1}{2}$ microjoule/cm$^2$). Gallium-Aluminum-arsenic semiconductor laser (emission wavelength 780 nm) was used as the light source in this case. The photomemory property ($P_M$) was evaluated with the time necessary for the photosensitive member to recover its original charge bearing characteristics after exposure thereof at an intensity of 600 lux for 3 minutes. Results thereof are shown in Table 1.

TABLE 1

| | |
|---|---|
| $V_o$ | −600 volt |
| $V_5$ | −580 volt |
| $P_M$ | 2 minutes |
| $E_{\frac{1}{2}}$ | 0.6 microjoule/cm$^2$ |

After corona charging at −5 KV, the photosensitive member was scanned with an imaging beam of gallium-aluminum-arsenic semiconductor laser, and subjected to magnetic brush development with a developer containing iron powder and a positive-working toner prepared from an epoxy resin, carbon, and Nigrosine, while applying a developing bias. The toner image was corona-transferred at −4.5 KV onto plain paper and fixed in an oven heater, giving a copy having no stain in the ground, with high fidelity to the original image information.

EXAMPLE 2

A photosensitive member was prepared and measured for its photographic characteristics, in the same manner as in Example 1 except for using copper phthalocyanine of type $\beta$ (Lionol Blue NCB Toner, mfd. by Toyo Ink Manufacturing Co., Ltd.) in place of the copper phthalocyanine of type $\epsilon$. Results thereof are shown in Table 2.

TABLE 2

| | |
|---|---|
| $V_o$ | −600 volt |
| $V_5$ | −580 volt |
| $V_M$ | 10 minutes |
| $E_{\frac{1}{2}}$ | 8.2 microjoule/cm$^2$ |

EXAMPLES 3–14

Photosensitive members were prepared and measured for photographic characteristics thereof, in the same manner as in Example 1 except for using the individual hydrazone compounds shown in Table 3 in place of the hydrazone compound used in Example 1. Results thereof are shown also in Table 3.

TABLE 3

| Example No. | Hydrazone compound No. | $V_o$ (volt) | $V_5$ (volt) | $P_M$ (min.) | $E_{\frac{1}{2}}$ (microjoule/cm$^2$) |
|---|---|---|---|---|---|
| 3 | No. (4) | −600 | −570 | 2 | 0.3 |
| 4 | No. (6) | −620 | −600 | 2 | 0.8 |
| 5 | No. (7) | −610 | −580 | 2 | 0.6 |
| 6 | No. (8) | −600 | −580 | 2 | 0.4 |
| 7 | No. (9) | −580 | −560 | 2 | 1.5 |
| 8 | No. (10) | −570 | −550 | 3 | 0.6 |
| 9 | No. (11) | −590 | −570 | 3 | 0.4 |
| 10 | No. (13) | −570 | −550 | 5 | 1.1 |
| 11 | No. (15) | −560 | −550 | 4 | 0.6 |
| 12 | No. (16) | −560 | −540 | 5 | 0.7 |
| 13 | No. (17) | −570 | −550 | 5 | 0.7 |
| 14 | No. (18) | −560 | −540 | 4 | 1.3 |

Comparative Examples 1–5

Photosensitive members were prepared and measured for photographic characteristics thereof, in the same manner as in Example 1 except for using the known charge-transporting compounds shown in Table 4 in place of the hydrazone compound used in Example 1. Results thereof are shown in Table 5.

TABLE 4

| Comparative Example No. | Charge-transporting compound |
|---|---|
| 1 | 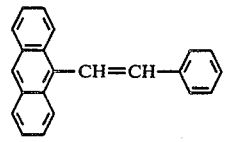 |
| 2 | 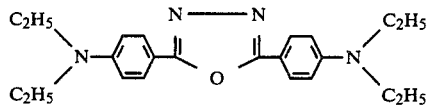 |
| 3 | 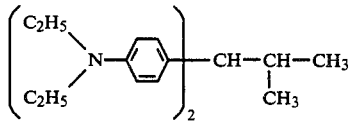 |
| 4 | 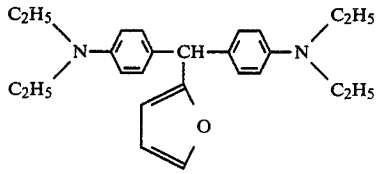 |
| 5 | 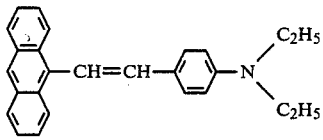 |

TABLE 5

| Comparative Example No. | $V_o$ (volt) | $V_5$ (volt) | $P_M$ (min.) | $E_{\frac{1}{2}}$ (microjoule/cm$^2$) |
|---|---|---|---|---|
| 1 | −350 | −240 | 40 | 13.5 |
| 2 | −380 | −260 | 40 | 5.0 |
| 3 | −320 | −220 | 35 | 11.2 |
| 4 | −330 | −210 | 40 | 9.8 |
| 5 | −390 | −300 | 30 | 7.5 |

As can be seen from the foregoing Example and Comparative Examples, the electrophotographic photosensitive member of this invention has a remarkably high sensitivity to the light of 750 nm or longer in wavelength, excellent charge bearing characteristics such as the initial potential, the dark decay and the like, and an improved anti-photomemory property.

EXAMPLE 15

A photosensitive member was prepared and used for image formation, as in Example 1 except for dispersing carbon black in the intermediary layer. As a result, no interference fringe-like pattern appeared.

EXAMPLE 16

A photosensitive member was prepared and measured for photographic characteristics, in the same manner as in Example 1 except that the vinyl butyral resin was used in a proportion of 2 parts by weight in stead of one part by weight in the dispersion to form the charge generation layer and the thickness of this layer was 0.1$\mu$ in stead of 0.3$\mu$. Results thereof are shown in Table 6.

TABLE 6

| | |
|---|---|
| $V_o$ | −600 volt |
| $V_5$ | −570 volt |
| $P_M$ | 3 minutes |
| $E_{\frac{1}{2}}$ | 0.5 microjoule/cm$^2$ |

What I claim is:

1. An electrophotographic photosensitive member comprising a photosensitive layer having a laminated structure of charge generation and charge transport layers on a conductive substrate, which is characterized in that the charge generation layer contains a copper phthalocyanine pigment of type epsilon and the charge transport layer contains a hydrazone compound represented by the following formula (I):

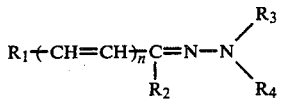

(I)

wherein $R_1$ represents substituted or unsubstituted aryl; $R_2$ represents hydrogen; $R_2$ and $R_4$ represent alkyl, aryl, or aralkyl, each substituted or unsubstituted; and n is 0 or 1, and a binder.

2. An electrophotographic photosensitive member of claim 1, wherein said charge generation comprises copper phthalocyanine and a binder.

3. An electrophotographic photosensitive member of claim 2, wherein the weight ratio of copper phthalocyanine to the binder in said charge generation layer is 1:1 to 3:1.

4. An electrophotographic photosensitive member of claim 3, wherein the weight ratio of copper phthalocyanine to the binder in said charge generation layer is 1.5:1 to 2.5:1.

5. An electrophotographic photosensitive member of claim 4, wherein the weight ratio of copper phthalocyanine to the binder in said charge generation layer is about 2:1.

6. An electrophotographic photosensitive member of claim 1, wherein $R_1$ in the formula (1) is a phenyl substituted by dialkylamino at the 4-position.

7. An electrophotographic photosensitive member of claim 6, wherein said dialkylamino is dimethylamino, diethylamino, dipropylamino, or dibutylamino.

8. An electrophotographic photosensitive member of claim 1, wherein $R_3$ and $R_4$ in the formula (1) represent aryl selected from the group consisting of phenyl, α-naphthyl, and β-naphthyl.

9. An electrophotographic photosensitive member of claim 1, wherein n in the formula (1) is zero.

10. An electrophotographic photosensitive member of claim 1, wherein said charge transport layer is formed on the charge generation layer.

11. An electrophotographic photosensitive member of claim 10, wherein an intermediary layer is laid between the charge generation layer and the conductive substrate.

12. An electrophotographic photosensitive member of claim 11, wherein said intermediate layer comprises conductive particles and a resin.

13. An electrophotographic photosensitive member of claim 12, wherein said conductive particles are of carbon black, silver, or aluminum.

14. An electrophotographic photosensitive member of claim 13, wherein said conductive particles are of carbon black.

15. An electrophotographic photosensitive member for a process which includes charging the face of said electrophotographic photosensitive member and scanning the charged face with a laser beam, wherein said electrophotographic photosensitive member comprises:

(a) a substrate comprising a metal surface;

(b) an intermediary layer disposed to prevent generation of an interference fringe upon forming an image, said layer comprising conductive particles and a resin; and (c) a photosensitive layer having a laminated structure of (i) a charge generation layer containing a copper phthalocyanine pigment of type X, epsilon or gamma and (ii) a charge transport layer containing a hydrazone compound and a resin.

16. The electrophotographic photosensitive member according to claim 15, wherein said laser beam has a wavelength of 650 nm or longer.

17. An electrophotographic photosensitive member according to claim 16, wherein said laser beam has a wavelength of 750 nm or longer.

18. An electrophotographic photosensitive member according to claim 15, wherein said laser beam is emitted from a semiconductor laser device.

19. An electrophotographic member according to claim 15, wherein said conductive particles are of carbon black.

20. An electrophotographic photosensitive member for a process which includes charging the face of said electrophotographic photosensitive member, scanning the charged face with a laser beam, and developing the electrostatic latent image with a developer, wherein said electrophotographic photosensitive member comprises:

(a) a substrate comprising a metal surface;

(b) an intermediary layer disposed to prevent generation of an interference fringe upon forming an image, said layer comprising conductive particles and a resin; and (c) a photosensitive layer having a laminated structure of (i) a charge generation layer containing a copper phthalocyanaine pigment of type X, epsilon or gamma and (ii) a charge transport layer containing a hydrazone compound and a resin.

21. An electrophotographic photosensitive member for a process which includes charging the face of said electrophotographic photosensitive member and scanning the charged face with a laser beam, wherein said electrophotographic photosensitive member comprises:

(a) a substrate comprising a metal surface;

(b) an intermediary layer disposed to prevent generation of an interference fringe upon forming an image, said layer comprising conductive particles and a resin; and (c) a photosensitive layer having a laminated structure of (i) a charge generation layer having a thickness of 0.01–1 micron and containing a copper phthalocyanine pigment and (ii) a charge transport layer containing a hydrazone compound and a resin.

22. An electrophotographic photosensitive member according to claim 21, wherein said laser beam has a wavelength of 650 nm or longer.

23. An electrophotographic photosensitive member according to claim 22, wherein said laser beam has a wavelength of 750 nm or longer.

24. An electrophotographic photosensitive member according to claim 21, wherein said laser beam is emitted from a semiconductor laser device.

25. An electrophotographic photosensitive member for use in a laser beam printer with a means scanning laser beam, wherein said electrophotographic photosensitive member comprises:

(a) a substrate comprising a metal surface;

(b) an intermediary layer disposed to prevent generation of an interference fringe upon forming an image, said layer comprising conductive particles and a resin, and (c) a photosensitive layer having a laminated structure of (i) a charge generation layer having a thickness of 0.01~1 micron and containing a phthalocyanine pigment, and (ii) a charge transport layer containing a hydrazone compound and a resin.

* * * * *

UNITED STATES PATENT AND TRADEMARK OFFICE

CERTIFICATE OF CORRECTION

PATENT NO. : 4,592,984

DATED : June 3, 1986

INVENTOR(S) : YUJI NISHIGAKI

It is certified that error appears in the above-identified patent and that said Letters Patent is hereby corrected as shown below:

COLUMN 13

Line 64, "intermediate" should read --intermediary--.

Signed and Sealed this

Twenty-fourth Day of March, 1987

*Attest:*

DONALD J. QUIGG

*Attesting Officer*

*Commissioner of Patents and Trademarks*